US005610572A

United States Patent [19]

Yajima

[11] Patent Number: 5,610,572

[45] Date of Patent: Mar. 11, 1997

[54] RESISTOR ELEMENT HAVING A PLURALITY OF GLASS LAYERS

[75] Inventor: Yasuhito Yajima, Nagoya, Japan

[73] Assignee: NGK Insulators, Ltd., Nagoya, Japan

[21] Appl. No.: 393,360

[22] Filed: Feb. 23, 1995

[30] Foreign Application Priority Data

Mar. 24, 1994 [JP] Japan ..... 6-053870
Jan. 12, 1995 [JP] Japan ..... 7-003013

[51] Int. Cl.[6] ..... H01C 7/10

[52] U.S. Cl. ..... 338/22 R; 338/256; 338/257; 338/262; 338/269; 338/275

[58] Field of Search ..... 338/22 R, 25, 338/229, 256–257, 262–264, 269, 270, 273, 275

[56] References Cited

U.S. PATENT DOCUMENTS

| | | | |
|---|---|---|---|
| 4,282,507 | 8/1981 | Tindall et al. | 338/25 |
| 4,909,079 | 3/1990 | Nishimura et al. | 73/204.27 |
| 5,020,214 | 6/1991 | Tsuruoka et al. | 29/611 |
| 5,124,682 | 6/1992 | Ishiguro | 338/22 R |
| 5,168,256 | 12/1992 | Ishiguro et al. | 338/25 |
| 5,300,916 | 4/1994 | Ishiguro et al. | 338/25 |
| 5,321,386 | 6/1994 | Ishiguro | 338/269 |
| 5,340,428 | 7/1995 | Gerblinger et al. | 338/25 |

FOREIGN PATENT DOCUMENTS

| | | | |
|---|---|---|---|
| 55-7926 | 4/1976 | Japan | 338/22 R |
| 1-180420A | 7/1989 | Japan . | |
| 2-304901 | 12/1990 | Japan | 338/256 |
| 4-107277A | 4/1992 | Japan . | |
| 5-223614A | 8/1993 | Japan . | |

*Primary Examiner*—Teresa J. Walberg
*Assistant Examiner*—Karl Easthom
*Attorney, Agent, or Firm*—Ronald J. Kubovcik, Esq.

[57] ABSTRACT

A resistor element has a ceramic substrate and a metallic resistor coated onto the substrate. The metallic resistor has varied electrical resistance depending on temperature. A pair of leads are electrically connected to the metallic resistor. A plurality of glass layers having different compositions are coated onto the metallic resistor. The second glass layer fills a hole formed in the first glass layer, thereby improving response of the resistor element. The second glass layer has a softening point lower than the first glass layer, thereby small bubbles remain dispersed in each glass layer without aggregation. An outermost glass layer is composed of a glass resisting chemicals or a glass resisting abrasion. An innermost glass layer is composed of a glass containing up to 3 percent by mole of a sum of $Na_2O$ and $K_2O$.

17 Claims, 2 Drawing Sheets

RESISTOR ELEMENT HAVING A PLURALITY OF GLASS LAYERS

BACKGROUND OF THE INVENTION

1. Field of the Invention

The present invention relates to a resistor element whose electrical resistance depends on temperatures. The resistor element is suitably used in a thermal flowmeter for measuring a flow rate of a fluid in a passage. The thermal flowmeter may be used in intake air introduced into an internal combustion engine. In these applications, the resistor element needs to have quick response and durability at high temperatures.

2. Description of Related Art

A resistor element used in a thermal flowmeter has a metallic resistor having an electrical resistance varying with temperature. The resistor element has a substrate, a metallic resistor supported by the substrate, a pair of leads for electrically connecting the metallic resistor to a circuit, and a glass layer coated onto the metallic resistor so as to protect the metallic resistor. The metallic resistor may be a film coated onto the substrate. Alternatively, the metallic resistor may be a wire that is wound around the substrate. The metallic resistor may be composed of platinum or an alloy including platinum.

The glass layer is made of a glass having a high thermal conductivity so as to ensure quick response of the metallic resistor to temperature changes. The glass layer protects the metallic resistor so that the metallic resistor does not corrode, abrade or change its electrical resistance even at high temperatures.

FIG. 3 shows a glass layer of a conventional resistor element. The resistor element has a ceramic substrate 22, a metallic film 24 coated onto a surface of the ceramic substrate 22, and a glass layer 25 coated onto the metallic film 24.

The glass layer 25 may have a bubble 28 therein due to the manufacturing process. The bubble in the glass layer does not conduct much heat so that the response of the metallic resistor to temperature changes is delayed. In the process of making the resistor element, a slurry including a glass and a binder is coated onto the metallic resistor, and the slurry is fired so as to form a glass layer. An organic compound may be present in the binder as an impurity. Alternatively, the organic compound may be stuck onto the metallic resistor from the beginning. During the firing step, the organic compound may become a gas, and the gas may remain trapped in the glass layer as bubbles.

In FIG. 3, the glass layer 25 has a hole 26 exposing a surface of the metallic resistor 24. The exposed surface of the metallic resistor 24 is susceptible to corrosion, abrasion and oxidation, and the metallic resistor 24 may change its electrical resistance over a long period. The glass layer 25 has a hole with a thin part 27. The part 27 may be erased by sand particles flowing with a gas, exposing the metallic resistor 24. During the step of firing the glass layer, the bubbles in the glass layer may explode, thereby forming the hole 26 and a thin part 27 in the glass layer.

SUMMARY OF THE INVENTION

An object of the present invention is to solve the aforementioned problem by having a plurality of glass layers. When an innermost, first glass layer that is in contact with the metallic resistor has a hole, another second glass layer is coated onto the first glass layer, filling the hole in the first glass layer.

An outermost glass layer in contact with atmosphere requires properties different from an innermost glass layer in contact with the metallic resistor. In the present invention, the outermost glass layer may be composed of one glass, and the innermost glass layer may be composed of another glass.

According to the present invention, a resistor element has a ceramic substrate. A metallic resistor is supported by the substrate. The metallic resistor has a positive temperature coefficient of resistance so as to have varied electrical resistance depending on temperature. A pair of leads are electrically connected to the metallic resistor. A protective coating is coated onto the metallic resistor, and the protective coating includes a plurality of glass layers having different compositions. The protective coating includes a first glass layer coated onto the metallic resistor and a second glass layer coated onto the first glass layer, and the second glass layer has a softening point lower than the first glass layer. A step of forming the second glass layer may include a step of firing a glass slurry coated onto the first glass layer. During the step of firing the second glass layer, it is advantageous that the first glass layer remains hard without softening.

The softening point of a glass refers to a temperature that, upon increasing temperatures, the glass reaches a viscosity coefficient of $10^{7.6}$. The following are experimental procedures for measuring the softening point of a glass. Firstly, the glass is formed into a fiber having a diameter of 0.55 to 0.75 mm and a length of 23.5 cm. Then an upper part of the fiber extending 10 cm along the axial direction from the top end is heated at a rate of about 5° C. per minute while the other lower parts of the fiber remain unheated. Lastly, when the fiber starts to elongate along the axial direction by its own weight at a rate of 1 mm per minute, then this is the temperature of the softening point.

Preferably, the second glass layer may have a softening point lower by not less than 30° C. than the first glass layer. Further preferably, the second glass layer has a softening point lower by not less than 45° C. than the first glass layer. Further preferably, the second glass layer has a softening point lower by not less than 60° C. than the first glass layer.

Preferably, the protective coating includes a third glass layer coated onto the second glass layer, and the third glass layer has a softening point lower than the second glass layer. Preferably, the third glass layer may have a softening point lower by not less than 30° C. than the second glass layer. Further preferably, the third glass layer has a softening point lower by not less than 45° C. than the second glass layer. Further preferably, the third glass layer has a softening point lower by not less than 60° C. than the second glass layer.

Preferably, each of the glass layers has a thickness up to 20 micrometers so as to have a quick response of the resistor element. The thickness may range from 2 to 15 micrometers and from 2 to 10 micrometers. Preferably, the protective coating has a thickness ranging from 5 to 80 micrometers so as to have quick response and the durability of the resistor element. The protective coating may have a thickness ranging from 10 to 60 micrometers and ranging from 10 to 30 micrometers.

Preferably, an outermost glass layer consists essentially of a glass for resisting chemicals or a glass for resisting abrasion. The glass for resisting chemicals refers to a glass resisting an acid or alkaline compound. The glass for resisting chemical includes, for example, a glass of $Na_2O$, $K_2O$—

RO—$SiO_2$ system. The glass of $Na_2O$, $K_2O$—RO—$SiO_2$ system may contain 100 parts by mole of $SiO_2$, 17–30 parts by mole of at least one of $Na_2O$ and $K_2O$, and about 1 part by mole of RO. RO refers to at least one compound of $ZrO_2$, $Al_2O_3$, and ZnO. Among the three compounds, $ZrO_2$ is most resistant to an acid or alkaline compound. Then $Al_2O_3$ is next tO $ZrO_2$, and ZnO is next to $Al_2O_3$.

The glass for resisting abrasion includes, for example, borosilicate glass. The borosilicate glass may contain 5 to 15 parts by mole of $B_2O_3$, 18 to 32 parts by mole of at least one of $Al_2O_3$ and CaO, and the balance being $SiO_2$.

The glass for resisting abrasion includes a glass composite containing a glass matrix and ceramic particles dispersed therein. The ceramic particles may be made of ceramics having a high melting point, such as $Al_2O_3$, SiC, SiN, etc., so that the ceramic particles maintain their shape during the firing step of the glass layer.

The glass for resisting abrasion may contain 5 to 50 parts by weight, preferably 5 to 30 parts by weight, of the ceramic particles in 100 parts by weight of the glass matrix. The ceramic particles may have a diameter up to 35% and preferably up to 20% of the thickness of the glass layer.

Preferably, the innermost glass layer may consist essentially of a glass containing up to 3 percent by mole of a sum of $Na_2O$ and $K_2O$. Further preferably, the innermost glass layer may consist essentially of a glass containing up to 2 percents by mole of a sum of $Na_2O$ and $K_2O$. $Na_2O$ and $K_2O$ are considered to oxidize the metallic resistor, thereby deteriorating a temperature coefficient of resistance thereof. Where the metallic resistor contains platinum, the oxidation reaction may give an oxide layer as well as a solid solution of platinum and the reduced Na and K. Therefore, a limited amount of the oxides in the innermost glass layer is favorable.

The feature to have a limited amount of the oxides in the innermost glass layer is preferably combined with the features of the outermost glass layer resisting chemicals or abrasion, thereby the resistor element resists both chemicals and abrasion.

BRIEF DESCRIPTION OF THE DRAWINGS

Further details are explained below with the help of the embodiments illustrated in the attached drawings.

DETAILED DESCRIPTION OF THE PREFERRED EMBODIMENTS

Figure 1:
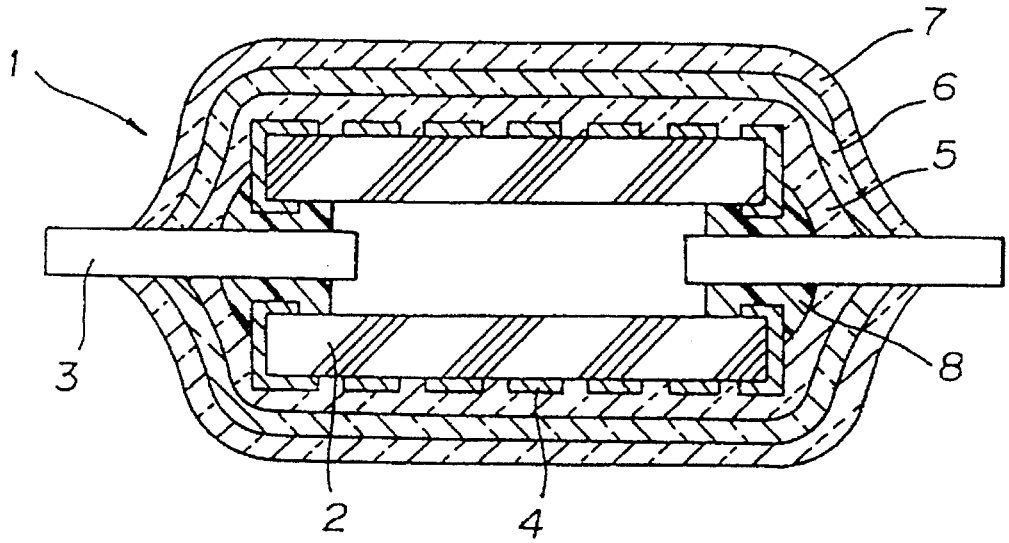
FIG. 1 is a cross section of the first embodiment of the resistor element of the present invention.

In FIG. 1, a resistor element 1 has a ceramic substrate 2 having a cylindrical shape and a bore extending between a pair of open ends. The ceramic substrate 2 includes a radially outer surface, a radially inner surface, and end surfaces.

A metallic film 4 having a spiral pattern is coated onto the radially outer surface of the ceramic substrate 2. The metallic film 4 has a positive temperature coefficient of resistance, thereby changing its electrical resistance depending on temperatures. The metallic film 4 continues to coat onto the end surfaces and ends of the radially inner surfaces of the ceramic substrate 2 so as to ensure electrical connection with connections 8, 8. The positive temperature coefficient of resistance is preferably large. The metal may include, for example, platinum, rhodium, nickel, tungsten, etc., and especially platinum is favorable. The metallic resistor may be composed of any of these metals, or an alloy including any of these metals.

One end of a pair of lead wires 3, 3 is inserted into a pair of open ends of the ceramic substrate 2, respectively. Connections 8, 8 fix the lead wires 3, 3 to the ceramic substrate 2. Connections 8, 8 are electrically conductive so that lead wires 3, 3 electrically connects to the metallic film 4.

A protective coating includes a first glass layer 5, a second glass layer 6, and a third glass layer 7. The first glass layer 5 is coated onto the metallic film 4 and connections 8, 8. The second glass layer 6 is coated onto the first glass layer 5, and the third glass layer 7 is coated onto the second glass layer 6. The second glass layer 6 has a softening point lower than the first glass layer 5, and the third glass layer 7 has a softening point lower than the second glass layer 6.

Glass compositions and softening points thereof are illustrated in Table 1.

TABLE 1

| | softening point (°C.) | $SiO_{22}$ | ZnO | $B_2O_3$ | $Na_2O$ | MgO | CaO | BaO | $Al_2O_3$ | $Ta_2O$ |
|---|---|---|---|---|---|---|---|---|---|---|
| A | 560 | 9~11 | 34~36 | 45~47 | | | | | | |
| B | 610 | 10~12 | 49~51 | 19~21 | | | 10~12 | | | |
| C | 610 | 7~9 | 60~62 | 30~32 | | | | | | |
| D | 625 | 34~36 | 15~17 | 26~28 | 4~5 | | | 10~12 | | |
| E | 635 | 9~10 | 60~63 | 24~26 | | | | | | 3~5 |
| F | 655 | 16~18 | 36~38 | 19~21 | | | 9~11 | | 10~12 | |
| G | 670 | 11~13 | 57~59 | 22~24 | | 5~6 | | | | |
| H | 765 | 23~25 | | 12~14 | | 29~31 | | 27~29 | | |

"Glass Engineering Handbook", edited by Taro Moritani, Sho Naruse, Masanaga Kuto, and Jin Tashiro, and published by Asakura Shoten pages 73–75 discloses. The relationship of glass compositions and viscosity, that is, of glass compositions and softening points.

Figure 2:
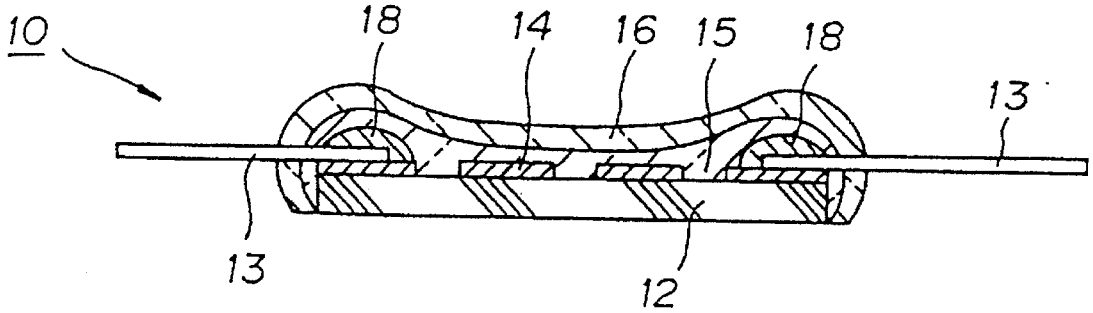
FIG. 2 is a cross section of the second embodiment of the temperature sensor of the present invention.
Figure 3:
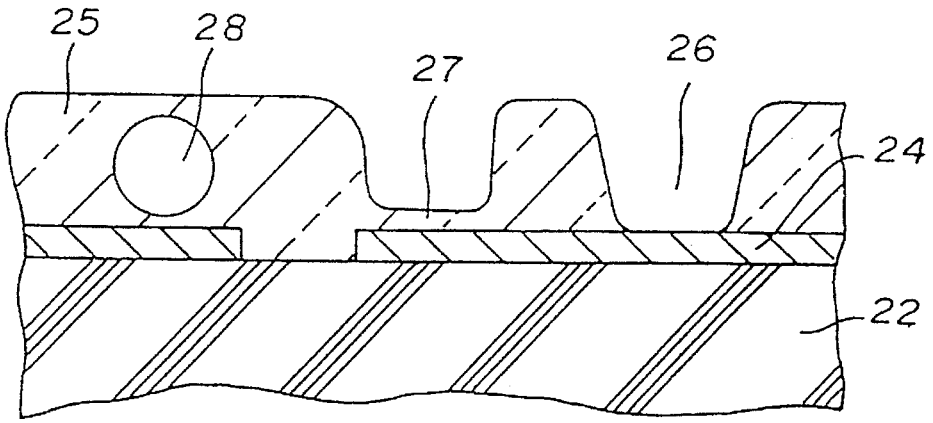
FIG. 3 is a cross section of a part of a conventional temperature sensor.

In FIG. 2, a ceramic substrate 12 has a planar shape having a pair of surfaces on opposite sides. A metallic resistor 14 having a film shape is coated onto one of the surfaces. The metallic resistor 14 has a continuous pattern changing its electrical resistance depending on temperatures.

A pair of lead wires 13, 13 are in contact with the metallic resistor 14. The lead wires 13, 13 are fixed to ends of the ceramic substrate 12 by connections 18, 18. The connections 18 are preferably electrically conductive.

A first glass layer is coated onto the metallic resistor 14 and the connections 18, 18, and the second glass layer 16 is coated onto the first glass layer 15. The second glass layer 16 has a softening point lower than the first glass layer 15.

Figure 4:
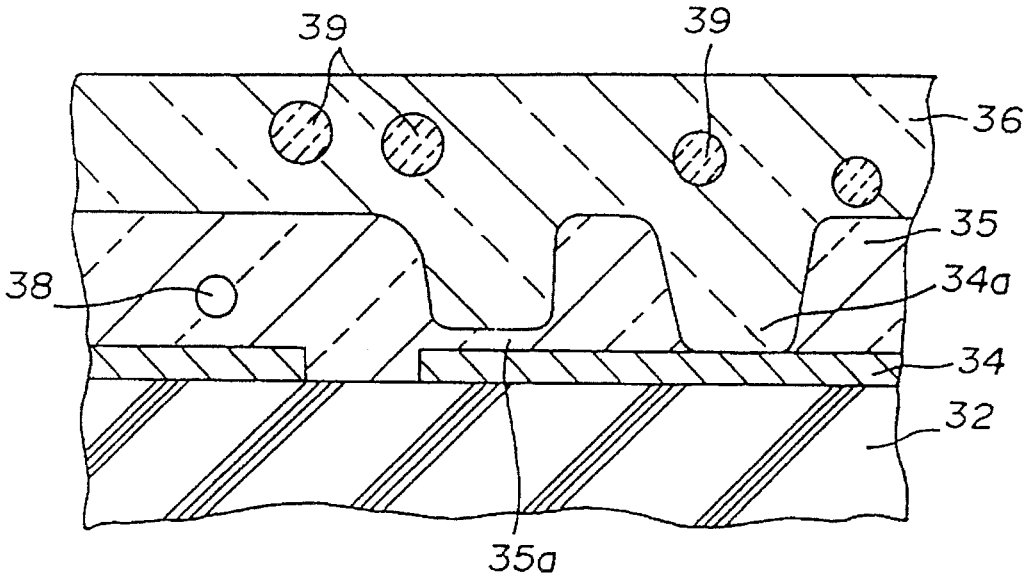
PRIOR ART FIG.4
FIG. 4 is a cross section of a part of the temperature sensor of the present invention.

In FIG. 4, a metallic film 34 is coated onto a surface of a ceramic substrate 32, and the first glass layer 35 is coated onto a surface of the metallic film 34. The second glass layer 36 is coated onto a surface of the first glass layer 35, filling a hole 34*a* where a surface of the metallic film 34 is exposed. The first glass layer 35 has a thin part 35*a*, and the thickness of the thin part 35*a* is filled up by the second glass layer 36.

In the present invention, bubbles 38 in each glass layer are smaller. In the present invention, each glass layer is separately formed without softening of the inner glass layer so that small bubbles 38 are dispersed in each glass layer without aggregation. Contrarily, when the inner glass layer is softened during the step of forming the adjacent, outer glass layer, bubbles in the inner glass layer may migrate into the outer glass layer, aggregating with another bubble to result in a larger bubble. The larger bubbles are more likely to explode.

Ceramic particles 39 are dispersed in the second glass layer 36 so that the second glass layer 36 is resistant to abrasion.

A process of making a resistor element is explained hereinafter. A ceramic substrate may be made of, for example, alumina, quartz, etc. The ceramic substrate preferably has a cylindrical shape having a bore extending between a pair of open ends. The outer diameter of the tube may range from 0.3 mm to 1 mm, and the length along its axial direction may vary from 2 mm to 3 mm. For example, an alumina tube having an outer diameter of 0.5 mm and an inner diameter of 0.3 mm may be used. Alternatively, the substrate has a planar shape.

In a process of making a resistor element having a film shape, the film may be formed onto a surface of the ceramic substrate by a known method such as sputtering, physical vapor deposition, chemical vapor deposition, electroplating etc. Alternatively, a glass interlayer may be disposed between the substrate and the metallic resistor.

In the subsequent step, the metallic resistor may be trimmed by laser irradiation so that the metallic resistor has a suitable pattern, such as a spiral or a zigzag pattern having a predetermined value in electrical resistance. The metallic resistor may be substantially composed of platinum or an alloy including platinum. The film preferably has a thickness ranging from 0.5 to 3 micrometers. The electrical resistance may range from several to 1000 ohms. The electrical resistance may be adjusted by the thickness, patterns, a pitch of the patterns, etc.

In the trimming step, an infrared laser or an ultraviolet laser may be used. For example, an yttrium aluminum garnet laser generates a ray having a diameter of 50 micrometers onto the metallic resistor while the ceramic substrate moves at a rate of 0.25 mm per second. The laser may have an oscillating frequency of one kilohertz and a power of 600 milliwatts.

A step of fixing lead wires to a substrate can be carried out prior to a final step of forming a protective coating. The step of fixing lead wires may be carried out prior to the step of forming the metallic film, between the step of coating the metallic film and the step of trimming the metallic film, or between the step of trimming the metallic film and the step of forming the protective coating.

The lead wire may be a metallic wire having a diameter ranging from 0.1 to 0.3 min. The lead wire may be made of a precious metal, such as platinum or rhodium. Alternatively, the lead wire may include a main wire consisting essentially of, for example, stainless steel or an iron-nickel alloy and a layer coated onto the radial surfaces of the main wire. The layer may be made of a precious metal, for example, platinum and an alloy including platinum.

A paste fixes the lead wire to the substrate. The paste is preferably electrically conductive, and the paste may include glass and metallic particles, for example, platinum dispersed therein. The paste forms a connection that connects the lead wire to the substrate. The connection electrically connects the lead wire to the film.

Alternatively, the paste may not necessarily be electrically conductive. In this embodiment, an electrically conductive layer may be formed onto a surface of the connection, so as to electrically connect lead wires to the metallic film through the electrically conductive layer. The electrically conductive layer may be made by forming a paste.

A method of coating the glass layer may include the steps of making a slurry including glass powder, putting the slurry onto the surfaces of the metallic resistor and connections, drying the slurry thereon, and firing the slurry. The slurry applying step can be carried out by immersion, blade coating, spray coating, etc. After forming the first glass layer, the procedures are repeated to form the subsequent layer. In the present invention, the glass for the subsequent, outer layer preferably has the glass having a lower softening point than the inner layer, thereby the inner layer remains hard during the step of forming the outer layer.

In the present invention, the protective coating may have an unlimited number of glass layers. However, preferably, the protective coat has two or three glass layers.

A process of making a resistor element having a metallic wire is basically the same as the process of making the resistor element having the metallic film. However, instead of forming the metallic film around the substrate, a metallic wire is wound around the substrate, and both ends of the metallic wire are electrically connected to the pair of lead wires by welding, respectively. The metallic wire may be a platinum wire. For example, an aluminum bobbin having a cylindrical shape, which has an outer diameter of 0.5 mm and an axial length of 2 mm, may be wound around by a platinum wire having a diameter of 20 micrometers with a pitch of 35 micrometers. The electrical resistance of the platinum wire may be about 20 ohms.

EXAMPLES

Examples 1–3

A resistor element of FIG. 1 is made by the following process except that in Examples 1 and 2, the protective coating has two glass layers. In Example 3, the protective coating has three glass layers, as shown in FIG. 1.

A ceramic substrate is an alumina tube having a cylindrical shape with a bore extending between a pair of open ends, and the alumina tube has an outer diameter of 0.5 mm, an inner diameter of 0.35 mm, and an axial length of 2 mm. A platinum film having a thickness of 0.5 micrometers is formed onto the outer radial surfaces and end surfaces of the alumina tube by a sputtering method. Then the film is trimmed by a laser into a spiral pattern so as to have an electrical resistance of 20 ohms.

Lead wires having a diameter of 0.22 mm are made by the steps of electroplating platinum onto radial surfaces of a stainless steel wire and cutting the wire. An electrically conductive paste made of 40% by volume of glass and 60% by volume of platinum particles attached to one end of lead wires, and the end of a pair of the lead wires are inserted into a pair of open ends of the alumina tube, respectively. Then, the precursor is fired so as to fix the lead wires to the alumina tube.

A glass paste for the glass layer is prepared. To a glass powder having an average diameter of 1 micrometer is added an organic binder and a solvent, and the mixture was mixed in a mortar. Then a viscosity of the glass paste is adjusted. The glass paste is coated onto the platinum film and the connections so as to have a substantially uniform thickness. Then the glass paste is dried so as to remove the solvent, and fired so as to form a solid first glass layer. The subsequent glass layers are formed in the same procedures.

100 samples are made in each of Example 1, 2, and 3. The resistor element thus obtained was inspected by a microscope with magnification of 30 times for the presence of bubbles in the glass layer, an exposed surface of the platinum film, and a part of a thin glass layer having a thickness up to 5 micrometers.

Table 2 summarizes experimental conditions including the type of glass, its softening point, firing temperatures, thickness of each glass layer. Table 2 further shows the result, that is, the number of resistor elements among 100 resistor elements that has bubbles in the glass layers, that has an exposed surface of the metallic resistor, and that has a part of the protective coating having a thickness up to 5 micrometers.

Comparative Examples 1 and 2

Only one glass layer is formed in Comparative Examples 1 and 2. The other structures of the resistor element of Comparative Examples 1 and 2 are the same as Examples 1–3. The result is shown in Table 2.

In the present invention, the presence of a plurality of glass layers reduces the number and the size of bubbles trapped in the glass layers, thereby improving the response of the resistor element. In the present invention, the metallic resistor is not exposed and the protective coating has sufficient thickness throughout without a thin part.

It is to be understood that various alterations, modifications and/or additions which may occur to those skilled in the art may be made to the features of possible and preferred embodiments of the invention as herein described without departing from the spirit and scope of the invention as defined in the claims.

What is claimed is:

1. A resistor element for a thermal flowmeter comprising:

a ceramic substrate;

a platinum film resistor, supported by said substrate, having a positive temperature coefficient of resistance;

a lead means electrically connected to said resistor; and a protective coating, coated onto said resistor, including a plurality of glass layers having different compositions, said protective coating including a first glass layer coated onto said resistor, said first glass layer consisting essentially of a glass containing up to 3 percent by mole of a sum of $Na_2O$ and $K_2O$, a second glass layer coated onto said first glass layer, said second glass layer having a softening point lower than said first glass layer, and an outermost glass layer consisting essentially of a glass for resisting chemicals or a glass for resisting abrasion.

2. A resistor element of claim 1, wherein said second glass layer has a softening point lower by not less than 30° C. than said first glass layer.

3. A resistor element of claim 1, wherein said second glass layer has a softening point lower by not less than 45° C. than said first glass layer.

TABLE 2

| | | glass composition | softening point (°C.) | firing temp. (°C.) | thickness (μm) | the number of samples among 100: bubbles in glass layers | exposed surface of the metallic resistor | a part of protective coating up to 5 μm |
|---|---|---|---|---|---|---|---|---|
| Example | | | | | | | | |
| 1 | first glass layer | $ZnO—B_2O_3$ system | 635 | 680 | 15 | 1 | 0 | 0 |
| | second glass layer | $PbO—B_2O_3$ system | 490 | 560 | 15 | | | |
| 2 | first glass layer | $CaO—BaO—Al_2O_3$ system | 850 | 950 | 20 | 2 | 0 | 0 |
| | second glass layer | $ZnO—B_2O_3$ system | 635 | 680 | 20 | | | |
| 3 | first glass layer | $B_2O_3$ system | 825 | 900 | 8 | | | |
| | second glass layer | $ZnO—B_2O_3$ system | 635 | 680 | 8 | 0 | 0 | 0 |
| | third glass layer | $Na_2O—ZnO—B_2O_3$ system | 560 | 610 | 15 | | | |
| Comparative Example | | | | | | | | |
| 1 | | $CaO—BaO—Al_2O_3$ system | 850 | 950 | 25 | 21 | 3 | 15 |
| 2 | | $ZnO—B_2O_3$ system | 635 | 680 | 30 | 32 | 2 | 9 |

In Examples 1–3, none of the 100 samples has an exposed metallic resistor, and none has a part of the protective coating having a thickness up to 5 micrometers. Moreover, the number of samples having bubbles in the glass layer decreased, compared to Comparative Examples 1 and 2. Sizes of the bubbles in Examples 1–3 are smaller than those in Comparative Examples 1 and 2.

4. A resistor element of claim 1, wherein said second glass layer has a softening point lower by not less than 60° C. than said first glass layer.

5. A resistor element of claim 1, wherein said protective coating includes a third glass layer coated onto said second glass layer, and said third glass layer has a softening point lower than said second glass layer.

6. A resistor element of claim 5, wherein said third glass layer has a softening point lower by not less than 30° C. than said second glass layer.

7. A resistor element of claim 1, wherein each of said glass layers has a thickness up to 20 micrometers.

8. A resistor element of claim 1, wherein said glass for resisting chemicals consists essentially of a glass containing 100 parts by mole of $SiO_2$, 17–30 parts by mole of at least one of $Na_2O$ and $K_2O$, and about 1 part by mole of RO, wherein RO refers to at least one compound of $ZrO_2$, $Al_2O_3$, and ZnO.

9. A resistor element of claim 1, wherein said glass for resisting abrasion consists essentially of a borosilicate glass.

10. A resistor element of claim 1, wherein said glass for resisting abrasion has a glass matrix and a plurality of ceramic particles dispersed therein.

11. A resistor element of claim 1, wherein said first glass layer consists essentially of a glass containing up to 2 percent by mole of a sum of $Na_2O$ and $K_2O$.

12. A resistor element of claim 1, wherein said substrate has a cylindrical shape having a radially outer surface and a bore extending between a pair of open ends, said resistor surrounds said radially outer surface, and an end of said lead is inserted into said open end of said bore.

13. A resistor element of claim 1, wherein said substrate has a planar shape having a pair of surfaces in opposite sides, said resistor is coated onto one of said surfaces of said substrate.

14. A resistor element for a thermal flowmeter comprising:

a ceramic substrate;

a platinum film resistor, supported by said substrate, having a positive temperature coefficient of resistance;

a lead means electrically connected to said resistor; and a protective coating, coated onto said resistor, including a plurality of glass layers having different compositions, said protective coating including a first glass layer coated onto said resistor, said first glass layer consisting essentially of a glass containing up to 2 percent by mole of a sum of $Na_2O$ and $K_2O$, a second glass layer coated onto said first glass layer, said second glass layer having a softening point lower than said first glass layer, and an outermost glass layer consisting essentially of a glass for resisting chemicals or a glass for resisting abrasion.

15. A resistor element of claim 14, wherein said glass for resisting chemicals consists essentially of a glass containing 100 parts by mole of $SiO_2$, 17–30 parts by mole of at least one of $Na_2O$ and $K_2O$, and about 1 part by mole of RO, wherein RO refers to at least one compound of $ZrO_2$, $Al_2O_3$, and ZnO.

16. A resistor element of claim 14, wherein said glass for resisting abrasion consists essentially of a borosilicate glass.

17. A resistor element of claim 14, wherein said glass for resisting abrasion has a glass matrix and a plurality of ceramic particles dispersed therein.

* * * * *